United States Patent [19]

Dreher

[11] 4,175,714

[45] Nov. 27, 1979

[54] METHOD AND APPARATUS FOR REELING A PLURALITY OF RIBBONS

[75] Inventor: George L. Dreher, Beloit, Wis.

[73] Assignee: Beloit Corporation, Beloit, Wis.

[21] Appl. No.: 907,186

[22] Filed: May 18, 1978

[51] Int. Cl.[2] ..... B65H 17/08; B65H 17/24; B65H 35/02; B65H 35/04

[52] U.S. Cl. ..... 242/65; 242/56 R; 242/56.6; 242/75.1

[58] Field of Search ..... 242/75.1, 65, 66, 56 R, 242/56.2, 56.6, 67.3 R, DIG. 3, 56 A, 67.1 R

[56] References Cited

U.S. PATENT DOCUMENTS

| | | | |
|---|---|---|---|
| 1,248,542 | 12/1917 | Pope | 242/65 |
| 1,959,418 | 5/1934 | Fourness | 242/75.1 X |
| 2,830,775 | 4/1958 | Kiesel | 242/56 R |
| 2,939,645 | 6/1960 | Rowlands et al. | 242/56 R |
| 3,061,225 | 10/1962 | Huck | 242/75.1 |
| 3,539,126 | 11/1970 | Meserve | 242/75.1 X |
| 3,675,868 | 7/1972 | Piattelli | 242/65 X |

*Primary Examiner*—Harvey C. Hornsby
*Assistant Examiner*—John M. Jillions
*Attorney, Agent, or Firm*—Dirk J. Veneman; Michael L. Gill; Gerald A. Mathews

[57] ABSTRACT

This apparatus utilizes a traveling looped conveyor belt upon which a plurality of previously slit web ribbons are received. The conveyor belt is then movably positioned to partially wrap a spool to simultaneously urge each of the ribbons into wrapping engagement with the rotating spool to be wound into a roll thereon. The traveling conveyor belt is selectively positionable about the spool and drive drum to permit removal of the wound roll and the positioning of a new spool so that transfer of the plurality of ribbons can be made from the wound roll to the next spool quickly and automatically at normal operating machine speed.

5 Claims, 4 Drawing Figures

METHOD AND APPARATUS FOR REELING A PLURALITY OF RIBBONS

BACKGROUND OF THE INVENTION

This invention relates to apparatus or simultaneously reeling (sometimes called "winding") a plurality of ribbons, such as formed from a slit paper web, onto a spool. More particularly, it relates to a reel which incorporates a looped, traveling belt which cooperates with the spool and drive drum by functioning to receive and convey the plurality of paper ribbons and wrap them onto the spool for reeling them into a plurality of spaced apart rolls on the same spool.

A very specialized grade of paper is often used in greeting cards, diplomas, scrolls and the like wherein the edges of the sheet have a unique, feathered appearance. This feathered edge can only be produced by subjecting the paper web to a special water jet shower while the web is in a very wet and insufficiently formed condition on the fourdrinier wire just ahead of the couch roll in a papermaking machine. Usually, a plurality of such water jet showers slit the web into the desired number of ribbons, each having its edges formed thereby in the distinctive feathered style.

The necessity of having to slit the machine-wide web into a plurality of relatively narrow ribbons, each being perhaps 12 to 24 inches wide, before they are wound into a roll imposes a severe problem at the reel where the normally machine-wide web is wound up.

In the past, when these ribbons were received at the end of the machine for reeling into a roll of paper (actually a plurality of separate, narrow rolls), each separate paper ribbon had to be guided by hand onto the spool to be wound into a narrow roll of paper. This necessitated a great deal of time to hand guide each of the ribbons, which might number 4 to 10 on a relatively wide papermaking machine, onto the spool. Since these transfers had to be done by hand, the procedure required slowing the machine down to a speed where this could be accomplished by the men at the back of the machine.

This method of handling the plurality of ribbons was clearly inefficient and uneconomical, but no better way of accomplishing this transfer had heretofore been devised.

Besides the inefficiencies associated with running the machine at slow speed in order to hand start the ribbons on the spool, such handling was dangerous and caused a lot of paper to be recycled through the broke pit since some ribbons had to be running off the end of the machine while the operator was threading the other ribbons, one by one onto the spool.

SUMMARY OF THE INVENTION

This invention obviates the problems associated with reducing machine speed during the transfer of the ribbons to the spool. In addition, the method and apparatus of this invention do not require human handling of the various ribbons at all during the transfer process.

The transfer of all the ribbons onto a spool simultaneously is accomplished by supporting the ribbons on a conveyor belt which extends the full width of the papermaking machine. The conveyor belt wraps the drive drum and extends upstream a short distance to receive the ribbons and guide them to the spool for transfer thereon. The conveyor belt thus provides lateral, cross machine stability for each of the relatively narrow ribbons, particularly during the critical stage of the transfer procedure where the direction of the ribbons is reversed as they are directed onto the initial wrap around the spool. This is accomplished automatically by positioning a roll mounted to a pivoted pair of arms within the looped conveyor belt. This enables the configuration of the traveling conveyor belt to be changed to selectively wrap and unwrap the spool as the spool itself pivotally moves about the periphery of the drive drum. Thus, the plurality of ribbons can be selectively urged to simultaneously wrap the spool during initial reeling thereon, and moved away after the ribbons start reeling into a plurality of separate rolls on the spool. All the while, the belt continues to receive and convey the oncoming ribbons. The pivoted transfer arms move the transfer roll out of the way to permit transfer of the spool onto a pair of secondary arms during the reeling process. A pair of secondary arms ultimately receive the spool and eventually move it away from the drive drum to permit the conveyor belt to commence wrapping the ribbons onto a new spool. At no time does the machine operator need to handle the ribbons.

Accordingly, it is an object of this invention to provide a method and apparatus for reeling a plurality of separate ribbons simultaneously onto a spool.

Another object is to provide a method and apparatus for effecting the transfer of a plurality ribbons onto a spool at substantially normal operating speeds of the papermaking machine.

Still another object is to provide a method and apparatus for effecting the reeling of a plurality of separate ribbons simultaneously without requiring hand transfer by a human operator.

A feature of the invention is the use of a traveling looped conveyor belt to support and transfer the plurality of ribbons.

These and other objects, features and advantages of the invention will readily become apparent to those skilled in the art upon reading the following description of the preferred embodiment with reference to the attached drawings.

IN THE DRAWINGS

DESCRIPTION OF THE PREFERRED EMBODIMENTS

Figure 1:
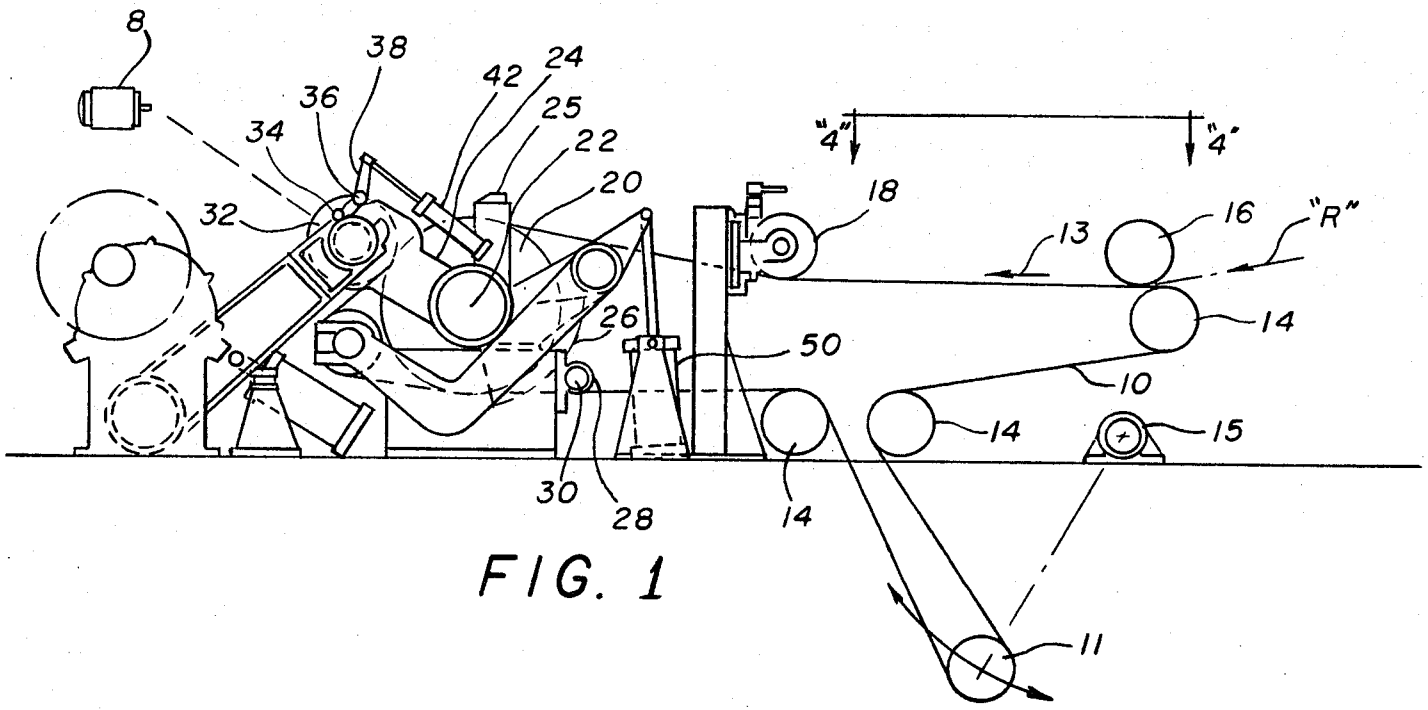
FIG. 1 is a side elevation view of the apparatus in normal operating position.

In FIG. 1, a conveyor belt 10 is shown disposed over a plurality of guide rolls 14 and drive drum 20. This conveyor belt is preferably made out of a woven fabric of any suitable material, such as plastic, metal or natural fibers, but it could be made of a formed material, such as rubber. Belt 10 is driven in the direction of arrow 13 by the drive drum which in turn is powered by a motor 6, illustrated schematically, which is coupled thereto in a conventional manner. The reel itself is designated generally as item 12.

Figure 4:
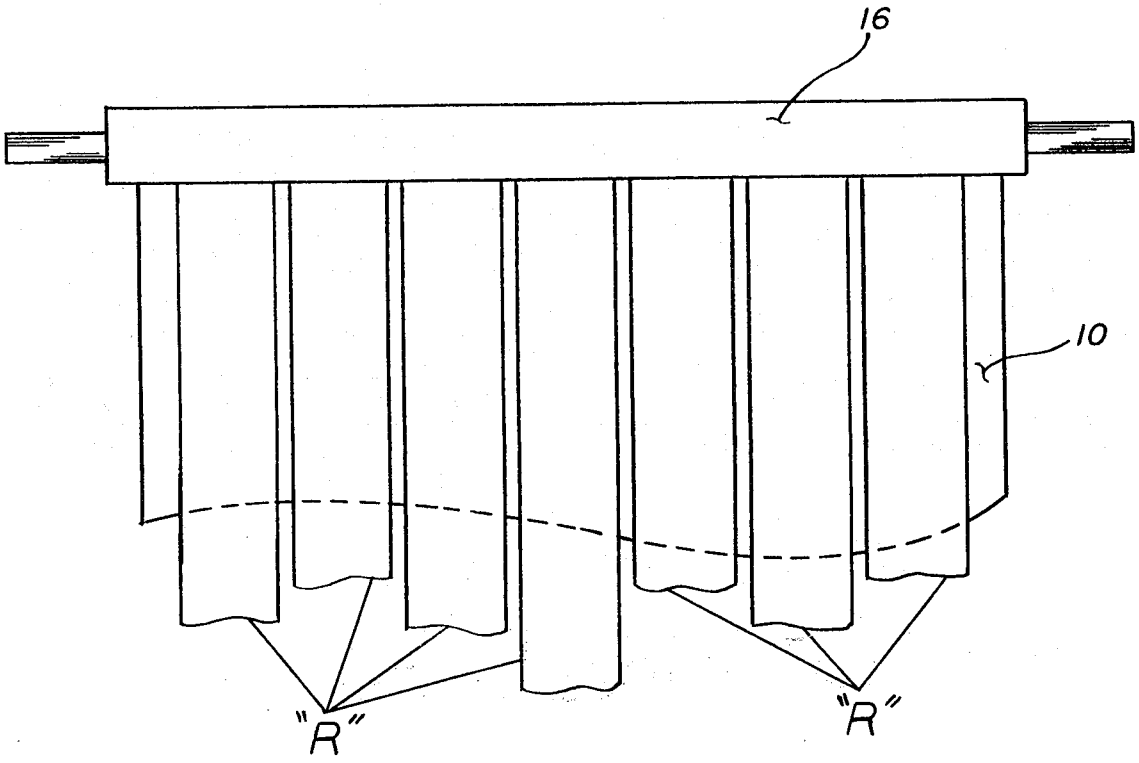
FIG. 4 is a plan view of a portion "4—4" over the conveyor belt in FIG. 1 showing the plurality of ribbons.

A paper roll 16 guides the plurality of paper ribbons "R", shown in FIG. 4, onto the conveyor belt 10. These paper ribbons are formed when a plurality of high pressure jet showers are disposed to impinge upon the paper web while on the fourdrinier forming wire at a point where the web has been formed, but not yet dewatered to the extent that the fibers are fixed into their final positions. This is accomplished just before the couch roll on the fourdrinier. The jet showers operate to separate the paper web into a plurality of ribbons "R" by washing away some fibers and displacing others so the ribbons thus produced have their edges formed in the unique and desirable feathered edge effect known in the industry as a "deckle edge". This unique, feathered edge can only be produced when the pulp fibers are in a relatively unfixed, plastic state and this state is only found in the forming area of a papermaking machine. In other words, the "deckle edge" cannot be produced by cutting, forming, or slitting, the web after it has dried. Thus, the plurality of ribbons must travel throughout the papermaking machine as a plurality of separate ribbons instead of a single wide web which could be slit after the paper web has been processed through the machine and wound into convenient rolls.

A web squaring, or centering, roll 18 may be positioned above the belt 10 to center the belt and ribbons as they travel onto the drive drum 20.

FIG. 1 illustrates the apparatus wherein the ribbons "R" are being wound onto a spool 32 which is nipped against the driven drive drum 20 to provide the rotating reeling force. The spool is supported in a yoke, generally designated with numeral 33, at the top of each of a pair of primary arms 24 which pivotally rotate about an axis 22 as does drive drum 20. One such primary arm 24 is mounted on either side of the drive drum in a frame 23. In fact, with the exception of the driving motors, the apparatus is basically symmetrical with arms and pressure cylinders at either side of the rolls.

The yoke formed in the top of the primary arms 24 permits the spool to be removed. Therefore, to insure that the spool 32 does not fall out or become removed at an undesired time, a locking arm 38 is mounted onto one side of each primary arm. At one end of each locking arm a locking roller 34 is mounted to secure the journal shaft of the spool into the yoke of each primary arm. Locking arm 38 pivots about a point 36 in one side of the primary arm yoke and the other end of the locking arm is attached to a hydraulic cylinder 42 which is mounted to each primary arm. Actuation of the hydraulic cylinder can thus move the locking roller into or out of engagement with the spool journal to permit removal of the spool from the primary arms as desired.

In operation, as the plurality of rolls corresponding in number to the plurality of ribbons "R" are initially being wound onto the spool 32, the spool is urged outwardly away from the drive drum in the yokes of the primary arms, which are positioned about 45° from the vertical, and its weight becomes supported more and more on a pair of secondary arms 60 which pivot about a centerline 68 of a shaft 69 mounted for linking the secondary arms 60 on either side of the spool. The secondary arms are mounted on a frame generally designated as item 21. The transfer arms 44 are in their lowered position as shown in FIG. 1, and the belt 10 is functioning to convey the ribbons onto the drive drum.

Due to the speed that the spool diameter increases during the reeling process, it soon reaches the tops of the yokes in the primary arms. At this point, a helper drive motor 8, illustrated schematically, engages the back end of the spool shaft to take over the winding power requirement. In order to maintain reel driving continuity, this engagement occurs either while the spool roll is still engaging the drive drum or immediately upon its transfer to the secondary arms. The manner in which motor 8 engages the end shaft of the spool is well known in the paper industry and forms no part of this invention, so it will not be explained in further detail.

After drive motor 8 has engaged the spool shaft, a hand wheel 62 is turned by the operator to rotate the wound rolls of paper ribbon, collectively designated 64, into an upright position on secondary arms 60 by the mechanical advantage supplied by gear box 63. Motor 8 continues to provide motive rotating force to the spool in the upright position. Primary arms 24 return to their vertical position, and the roll 64 is wound to the desired size.

Figure 2:
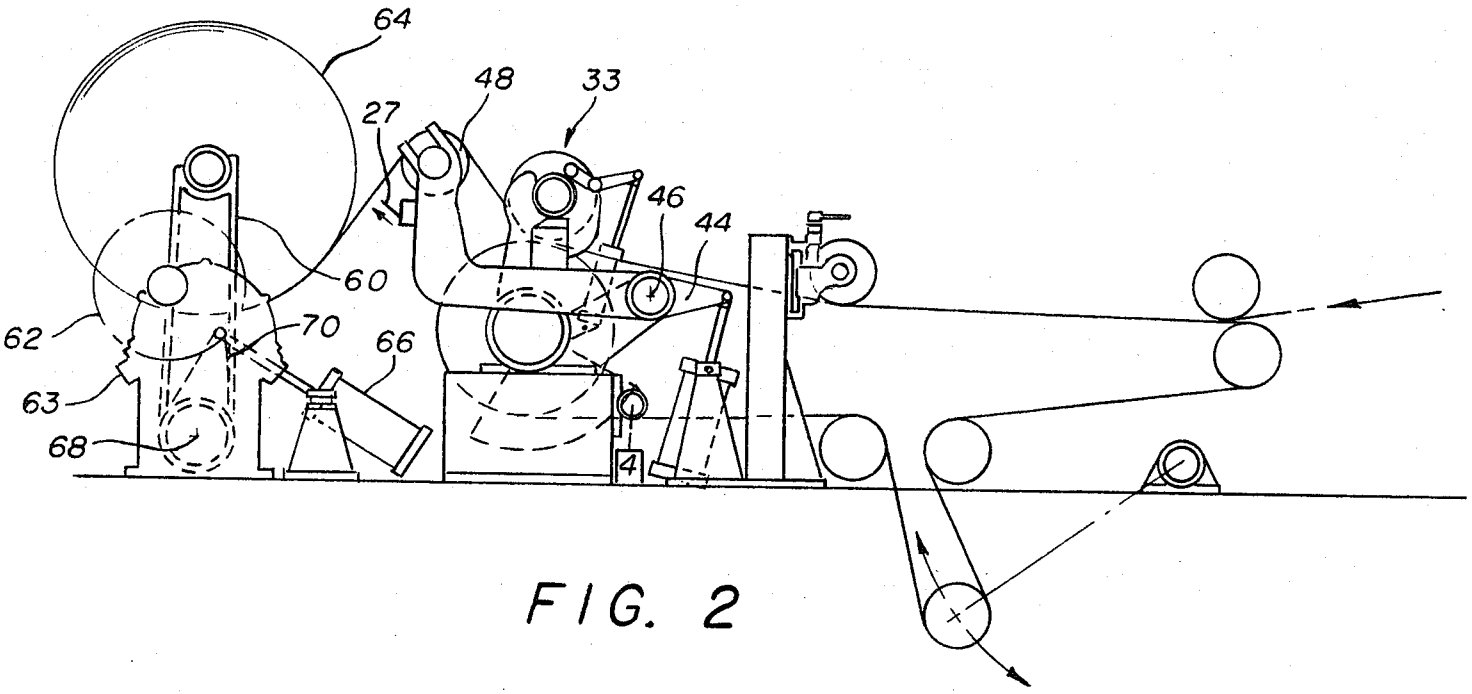
FIG. 2 is a side elevation view of the apparatus just as the conveyor belt is beginning the transfer of the ribbons onto a spool.

In continuing operation, assuming that a new spool is to be started, the transfer arms 24 are moved upwardly to their position shown in FIG. 2. Hydraulic cylinders 42 are retracted thus pivoting the locking rolls 34 upwardly out of the way to permit a spool to be deposited in the upwardly, substantially vertically extending yoke ends of primary arms 24 as they are positioned in FIG. 2. The primary arms 24 are positioned such that when the journals of the spool 32 are received on them, they are supported on the top of a pad 25 which is part of either side of the reel frame 23. At this position on top of pads 25, there is a gap between the spool surface and the top of drive drum 20 over which the conveyor belt is traveling. The arms of hydraulic cylinders 42 are activated to position the locking rollers 34 over the top of the spool journals to hold them in the primary arms 24.

All this time, either a plurality of web ribbons is being reeled on a spool positioned on the upright secondary arms as just described, or the initial ribbons are being received on the upstream end of the conveyor belt.

In either case, hydraulic cylinders 50 are then actuated to continue to raise the transfer arm roll 48 upwardly about pivot point 46 to wrap the traveling conveyor belt partially about the surface of the spool. As the transfer arm rotates upwardly about the spool, the plurality of paper ribbons supported on the conveyor belt are urged upwardly, over and onto the spool where the direction of the traveling belt urges the traveling ribbons to circumvent the spool and begin winding their respective rolls of paper thereon into a collective roll 64. Thus, the belt is positioned so that the ribbons are in initial reeling engagement with the spool.

Figure 3:
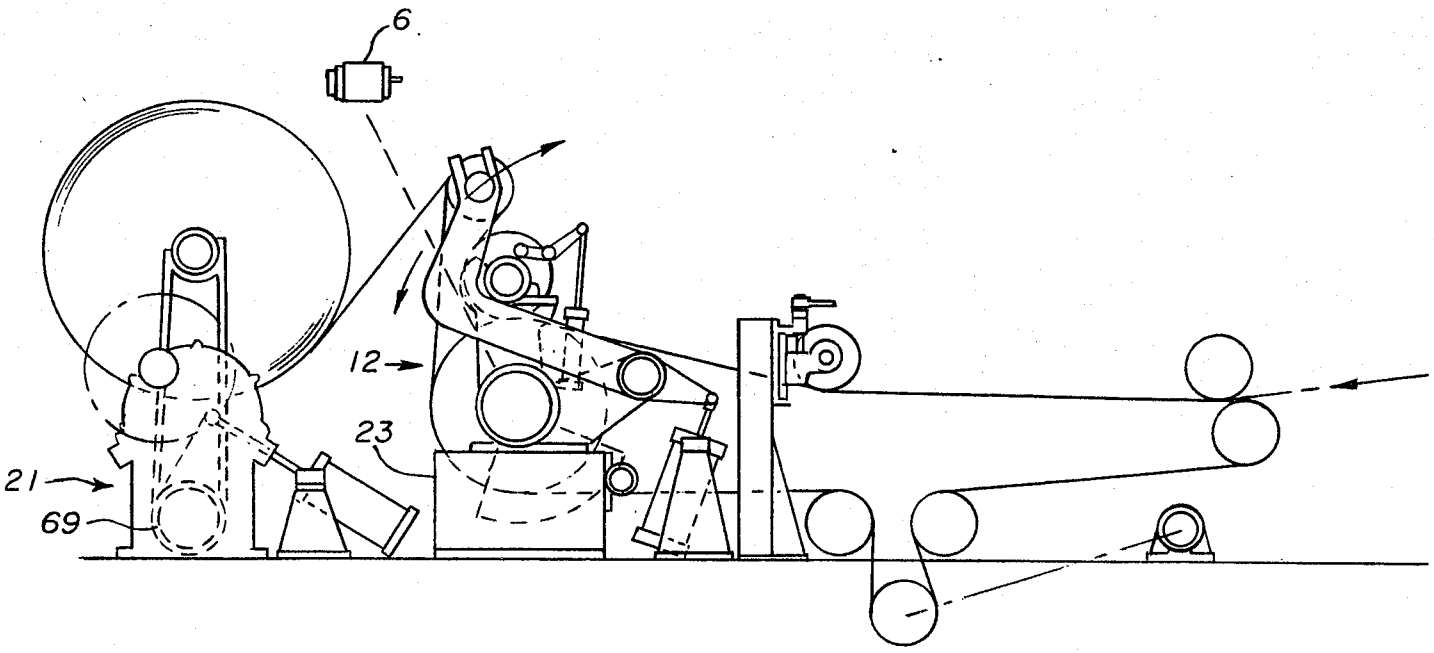
FIG. 3 is a side elevation view similar to that shown in FIG. 2, but illustrating a further extension of the conveyor belt over the spool which is now engaged with the drive drum.

As the transfer arms 44 are rotated from the intermediate position shown in FIG. 2 to their uppermost position shown in FIG. 3, a drive motor 4 operably engaged with pinion 28 on shaft 30 rotatably moves the primary arms counterclockwise via a gear segment 26 attached thereto to move the spool downwardly off the tops of pads 25 and over a beveled surface thereon so that the surface of the spool is lowered into driving contact with the traveling conveyor belt 10 on the surface of drive drum 20. This is the situation as shown in FIG. 3.

If the new spool is started while a previous paper roll 64 is being finished, the ribbons are cut by a knife 27, mounted to transfer arms 44, while the transfer arms are substantially in their position shown in FIG. 2. Knife 27 isn't essential to sever the ribbons—it's convenient. The ribbons could be severed merely by the tension created when the transfer roll urges the belt upwardly while the paper roll 64 is on the secondary arms. During the rotation of transfer arms 44, tension in the belt 10 is maintained by guide roll 11 which is pivotally mounted in a pair of arms to rotate about a pivot 15 as somewhat schematically shown in the figures to provide tension due to its weight.

After the traveling belt has started wrapping the ribbons around the spool (FIG. 3), the transfer arms are rotated downwardly to the position shown in FIG. 1. Primary arms 24 rotate the spool about 45 degrees counterclockwise about the surface of driving drive drum 20 where the shafts on either end of the spool engage the secondary arms 60 which also have yoke shaped ends for that purpose. The increasing diameter of the wound rolls 64 eventually forces the axles of the spool out of the primary arm yokes and into the yokes in the secondary arms. During the early stages of forming the new rolls of wound ribbons, the spool is driven by its frictional engagement with the traveling conveyor belt which in turn is driven by the drive drum 20. As the buildup of ribbons makes the roll 64 on the spool larger while on the primary arms, it may eventually reach a point where its inertia is such that it can no longer be driven at the desired speed solely by its frictional engagement with the traveling belt. The driving time by frictional contact can be prolonged by urging the secondary arms clockwise by the actuation of hydraulic pressure cylinders 66 to increase the nipping force of rolls 64 on the drive drum via lever arms 70 mounted to shaft 69 to which secondary arms 60 are also mounted. Hydraulic cylinders 66 are optional since, if desired, rolls 64 can be rotatably driven by centerwind drive motor 8 immediately upon disengagement of rolls 64 from frictional drive engagement with the drive drum 20 when the spool 32 is transferred to secondary arms 60. Such transfer from the primary to secondary arms can be made very soon after the start of a new spool. Since the yokes on the primary arms are not very deep, transfer to the secondary arms occurs relatively quickly in any case. Use of hydraulic cylinders 66 increases the time rolls 64 are frictionally wound on the drive drum .

Alternately, hydraulic cylinders could be used to both load the rolls 64 against the drive drum for as long as desired and then used to position the secondary arms in the vertical position. Centerwind drive motor 8 would provide the rotating power when rolls 64 were not in frictional engagement with the drive drum. Of course, if the roll 64 on the spool is as large as desired when the transfer from the primary arms to the secondary arms is made, or if a bad start has been made on a new spool necessitating a quick start of another spool, then the roll could be immediately removed from the secondary arms while a new spool is being started. In any such event, the secondary arms would have to rotate the winding reel spool out of the way to permit the transfer arm roll 48 to be positioned to start the new spool.

As the spool is being transferred from the primary arms to the secondary arms, hydraulic cylinders 42 are activated to rotate the locking roller out from above the yoke at the top of each primary arm so that the spool can be transferred to the secondary arms.

When the wound rolls 64 of paper ribbons reach the desired diameter, transfer arms 44 are raised to engage the ribbons with transfer arm roll 48 and knife 27 is actuated to sever the web. A crane used to lift the finished roll of paper ribbons from the upright secondary arms and a new spool is deposited on the top of beveled pads 25 where it is received in the yoke of the primary arms which have returned to the upright position after they have transferred the previous spool onto the secondary arms.

Thus, it is seen that a novel method and apparatus for reeling a plurality of ribbons simultaneously has been described which achieves the stated objectives. Naturally, some variations in the method and apparatus will be readily perceived by those skilled in the art which fall within the general concept and scope of the invention. For example, while the preferred conveyor has been described as a looped, traveling belt, it is anticipated that a non-traveling, smooth, flexible surface, such as a polished metal sheet, could be used as the conveyor. In this case, the transfer arms would function to movably guide the end of the metal sheet about the surface of the spool to urge the ribbons into reeling engagement therewith.

Also, while some elements of the apparatus have been described as being pivotable, they could just as well be articulated in such a manner as to be more accurately characterized as being "movable".

What is claimed is:

1. Apparatus for simultaneously reeling a plurality of traveling ribbons onto a spool comprising, in combination:

a reel including a rotatably mounted drum and a movable pair of primary arms for receiving a spool and selectively positioning the spool circumferentially about the drum and into nipping engagement therewith;

a motor operatively connected with the drum for rotatably driving the drum;

a conveyor for receiving a plurality of traveling ribbons, said conveyor comprising a belt looped about the drum whereby the plurality of ribbons are conveyed over the drum and into proximity with the spool positioned about the drum surface;

means for selectively moving the conveyor into a first position about the spool for urging the traveling ribbon into initial reeling engagement with the spool and into a second position whereby the ribbons are conveyed over the drum while being wound onto the spool;

a pair of secondary arms movably mounted about the drum for receiving the spool wrapped with ribbons from the primary arms and removing the spool from proximity with the drum.

2. Apparatus as set forth in claim 1, further including:

means for rotatably powering the spool while the spool is supported on the secondary arms.

3. Apparatus as set forth in claim 1, wherein:

the means for selectively positioning the conveyor comprises a pair of transfer arms for engaging the conveyor.

4. Apparatus as set forth in claim 3, wherein:

the transfer arms further include a transfer roll disposed within the looped belt whereby the belt is selectively wrapped about the spool and into ribbon conveying engagement with the drum.

5. A method for simultaneously reeling a plurality of ribbons onto a spool which is selectively positioned circumferentially about the surface of a rotatably driven drum in a reel, comprising the steps of:

receiving and supporting the ribbons on a conveyor belt which is looped around the drum;

moving the spool into nipping engagement with the conveyor belt over the drum;

moving the conveyor belt and directing it into partially wrapping engagement with the spool, thereby continuously and simultaneously conveying and supporting the ribbons and urging the ribbons into reeling engagement with the spool;

removing the conveyor belt from ribbon wrapping engagement with the spool while continuing to convey the ribbons to the spool;

reeling the ribbons onto the spool;

removing the spool from reeling engagement with the driven drum.

* * * * *